US010047582B2

(12) United States Patent
Hekelaar

(10) Patent No.: US 10,047,582 B2
(45) **Date of Patent: *Aug. 14, 2018**

(54) EXTENDED DURATION SECTION MILL AND METHODS OF USE

(71) Applicant: Smith International, Inc., Houston, TX (US)

(72) Inventor: Stephen Hekelaar, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 4 days.

This patent is subject to a terminal disclaimer.

(21) Appl. No.: 15/210,298

(22) Filed: Jul. 14, 2016

(65) Prior Publication Data

US 2016/0319619 A1 Nov. 3, 2016

Related U.S. Application Data

(63) Continuation of application No. 13/954,357, filed on Jul. 30, 2013, now Pat. No. 9,404,331.

(60) Provisional application No. 61/677,969, filed on Jul. 31, 2012.

(51) Int. Cl.

| | |
|---|---|
| ***E21B 29/00*** | (2006.01) |
| ***E21B 33/13*** | (2006.01) |
| ***E21B 17/10*** | (2006.01) |
| ***E21B 34/10*** | (2006.01) |

(52) U.S. Cl.

CPC ..... *E21B 29/005* (2013.01); *E21B 17/1078* (2013.01); *E21B 33/13* (2013.01); *E21B 34/10* (2013.01)

(58) Field of Classification Search

CPC ..... E21B 29/005; E21B 29/06; E21B 34/14; E21B 10/32; E21B 10/322

See application file for complete search history.

(56) References Cited

U.S. PATENT DOCUMENTS 2,353,284 A * 7/1944 Barrett ..... B23B 5/16 166/55.8
2,481,637 A 9/1949 Yancey
2,525,007 A 10/1950 Worden et al.
2,754,088 A * 7/1956 Kammerer, Jr. ..... E21B 10/34 175/280

(Continued)

FOREIGN PATENT DOCUMENTS

WO 2013126752 A1 8/2013

OTHER PUBLICATIONS

International Search Report and Written Opinion of PCT Application No. PCT/US2013/052977 dated Oct. 18, 2013, 18 pages.

(Continued)

*Primary Examiner* — Jennifer H Gay

(57) ABSTRACT

A section mill for removing a portion of a casing in a wellbore. The section mill may include a body having a first end portion, a second end portion, and a bore formed axially therethrough. A plurality of blades may be coupled to the body. Each of the blades may have a first end portion and a second end portion. The first end portion of each blade may be coupled to the body via a hinge pin, and the second end portion of each blade may have a cutting surface formed thereon. A seat may be formed within the bore. The blades may be adapted to actuate from an inactive position to an active position in response to an impediment forming a seal against the seat.

18 Claims, 11 Drawing Sheets

(56) References Cited

U.S. PATENT DOCUMENTS

| | | | | |
|---|---|---|---|---|
| 2,799,479 | A * | 7/1957 | Kammerer | E21B 10/322 166/316 |
| 3,050,122 | A | 8/1962 | Huitt et al. | |
| 3,254,720 | A | 6/1966 | Huitt et al. | |
| 3,554,305 | A | 1/1971 | Kammerer, Jr. | |
| 4,119,151 | A | 10/1978 | Smith | |
| 4,887,668 | A | 12/1989 | Lynde et al. | |
| 5,201,817 | A | 4/1993 | Hailey | |
| 5,392,862 | A | 2/1995 | Swearingen | |
| 5,642,787 | A | 7/1997 | Hutchinson | |
| 5,720,349 | A | 2/1998 | Pleasants et al. | |
| 5,788,000 | A | 8/1998 | Maury et al. | |
| 6,202,752 | B1 | 3/2001 | Kuck et al. | |
| 7,762,330 | B2 | 7/2010 | Saylor, III et al. | |
| 7,866,397 | B2 | 1/2011 | Lee | |
| 8,555,955 | B2 | 10/2013 | Davis | |
| 8,936,110 | B2 | 1/2015 | Adam | |
| 9,404,331 | B2 * | 8/2016 | Hekelaar | E21B 29/005 |
| 9,416,635 | B2 * | 8/2016 | Hekelaar | E21B 43/112 |
| 9,677,355 | B2 * | 6/2017 | Oxford | C22C 1/0408 |
| 9,759,013 | B2 * | 9/2017 | Radford | E21B 7/28 |
| 2006/0137877 | A1 | 6/2006 | Watson et al. | |
| 2008/0128169 | A1 | 6/2008 | Radford et al. | |
| 2009/0266544 | A1 | 10/2009 | Redlinger et al. | |
| 2010/0006290 | A1 | 1/2010 | Saylor, III et al. | |
| 2010/0089583 | A1 | 4/2010 | Xu et al. | |
| 2011/0073371 | A1 | 3/2011 | Radford | |
| 2011/0073376 | A1 | 3/2011 | Radford et al. | |
| 2011/0127044 | A1 | 6/2011 | Radford et al. | |
| 2011/0214873 | A1 | 9/2011 | Krieg et al. | |
| 2012/0055714 | A1 | 3/2012 | Adam | |
| 2012/0152543 | A1 | 6/2012 | Davis | |
| 2012/0298422 | A1 | 11/2012 | Oxford | |
| 2013/0153300 | A1 | 6/2013 | Radford et al. | |
| 2014/0027117 | A1 * | 1/2014 | Hekelaar | E21B 43/112 166/297 |
| 2014/0034317 | A1 | 2/2014 | Hekelaar | |
| 2015/0267493 | A1 | 9/2015 | Schwartze et al. | |
| 2016/0319619 | A1 * | 11/2016 | Hekelaar | E21B 29/005 |

OTHER PUBLICATIONS

Notice of Allowance and Fee(s) Due in U.S. Appl. No. 13/954,357 dated Mar. 30, 2016, 5 pages.

* cited by examiner

EXTENDED DURATION SECTION MILL AND METHODS OF USE

CROSS-REFERENCE TO RELATED APPLICATIONS

This application is a continuation of U.S. patent application Ser. No. 13/954,357, filed Jul. 30, 2013, entitled "Extended Duration Section Mill and Methods of Use", now U.S. Pat. No. 9,404,331, which claims the benefit of, and priority to, U.S. Provisional Application Ser. No. 61/677,969 filed Jul. 31, 2012, entitled "Extended Duration Section Mill and Methods of Use," the disclosures of which are incorporated by reference herein in their entireties.

BACKGROUND

When a wellbore is no longer producing, the wellbore may be prepared for abandonment. A segment of the casing is removed to form an openhole section of the wellbore. The openhole section is then plugged, and the wellbore is abandoned. To remove the segment of the casing, a tool string having a section mill coupled thereto is run into the wellbore. Once the section mill reaches the desired depth in the wellbore, fluid pressure is applied to the section mill via the through-bore of the tool string. The fluid pressure causes one or more blades to extend radially outward from the section mill and into contact with the casing. The section mill is rotated about its longitudinal axis (by rotating the tool string) causing the blades to cut through the casing. Once the section mill has cut through the casing, the tool string gradually lowers the section mill, and the blades mill the casing to remove the axial segment thereof.

As the blades mill the axial segment of the casing, the blades become worn down. Accordingly, oftentimes the blades of the section mill are only capable of milling relatively short segments of the casing, e.g., less than about 30 m, before they become worn down and ultimately ineffective. When longer segments of the casing need to be milled, the tool string and section mill are pulled out of the wellbore, a new section mill replaces the worn down section mill, the tool string and the new section mill are run back into the wellbore, and the above process is repeated to continue milling the casing. Replacing the worn down section mill during the milling process is time consuming, which leads to lost profits in the field.

Accordingly, what is needed is an apparatus and method for removing an extended (or longer) axial segment of a casing in a single trip downhole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A section mill for removing a portion of a casing in a wellbore is disclosed. The section mill includes a body having a first end portion, a second end portion, and a bore formed axially therethrough. A plurality of blades may be coupled to the body. Each of the blades has a first end portion and a second end portion. The first end portion of each blade may be coupled to the body via a hinge pin, and the second end portion of each blade may have a cutting surface formed thereon. A seat may be formed within the bore. The blades may be adapted to actuate from an inactive position to an active position in response to an impediment forming a seal against the seat.

A downhole tool for removing a portion of a casing in a wellbore is also disclosed. The downhole tool may include a first section mill having a first end portion, a second end portion, and a first axial bore formed therethrough. A first plurality of blades may be coupled to the first section mill. The first plurality of blades each has a first end portion and a second end portion. The first end portion of each of the first plurality of blades may be coupled to the first section mill via a first hinge pin, and the second end portion of each of the first plurality of blades may have a cutting surface formed thereon. A seat may be formed within the first bore. The first plurality of blades may be adapted to actuate from an inactive position to an active position in response to an impediment forming a seal against the seat. A first stabilizer may be coupled to the second end portion of the first section mill. A second axial bore may be formed through the first stabilizer such that the first and second bores are in fluid communication with one another. A second section mill may be coupled to the first stabilizer and have a first end portion, a second end portion, and a third axial bore formed at least partially therethrough. The third bore may be in fluid communication with the first and second bores. A second plurality of blades may be coupled to the second section mill. The second plurality of blades each has a first end portion and a second end portion. The first end portion of each of the second plurality of blades may be coupled to the second section mill via a second hinge pin, and the second end portion of each of the second plurality of blades may have a cutting surface formed thereon.

A method for removing a portion of a casing in a wellbore is also disclosed. The method may include running a downhole tool into the wellbore. The downhole tool may include a first section mill having a first end portion, a second end portion, and a first axial bore formed therethrough. A first plurality of blades may be coupled to the first section mill. The first plurality of blades each has a first end portion and a second end portion. The first end portion of each of the first plurality of blades may be coupled to the first section mill via a first hinge pin, and the second end portion of each of the first plurality of blades may have a cutting surface formed thereon. A seat may be formed within the first bore. The first plurality of blades may be adapted to actuate from an inactive position to an active position in response to an impediment forming a seal against the seat. A first stabilizer may be coupled to the second end portion of the first section mill. A second axial bore may be formed through the first stabilizer such that the first and second bores are in fluid communication with one another. A second section mill may be coupled to the first stabilizer and have a first end portion, a second end portion, and a third axial bore formed at least partially therethrough. The third bore may be in fluid communication with the first and second bores. A second plurality of blades may be coupled to the second section mill. The second plurality of blades each has a first end portion and a second end portion. The first end portion of each of the second plurality of blades may be coupled to the second section mill via a second hinge pin, and the second end portion of each of the second plurality of blades may have a cutting surface formed thereon. The second plurality of blades may be actuated from an inactive position to an active position in response to an increase in pressure in the third bore, and the cutting surfaces of the second plurality of blades may be disposed radially outward from an outer surface of the second section mill in the active position.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only exemplary embodiments, and are, therefore, not to be considered limiting of its scope, for the invention can admit to other equally effective embodiments.

DETAILED DESCRIPTION

Figure 1:
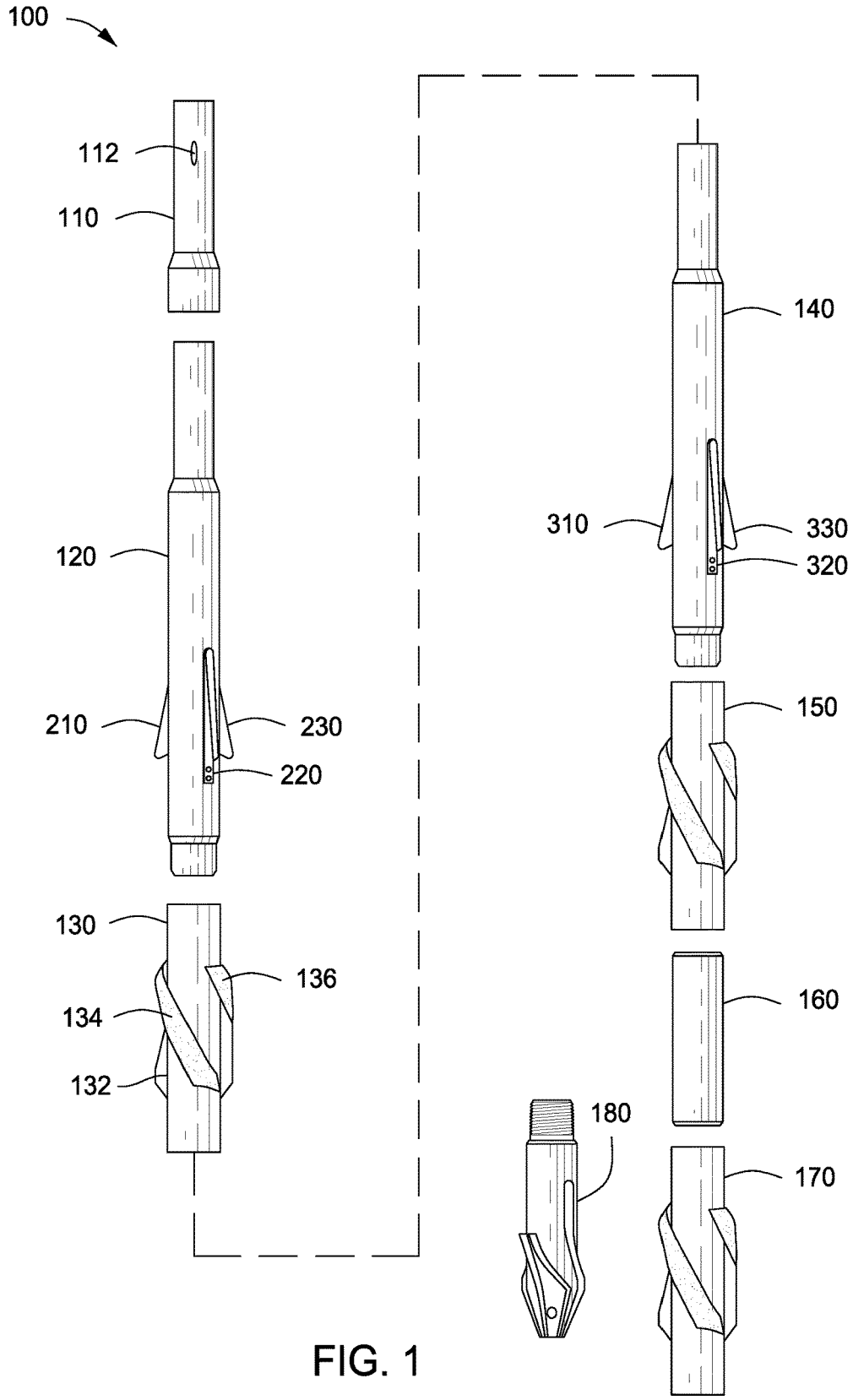
FIG. 1 depicts an illustrative downhole tool for removing a segment of a casing in a wellbore, according to one or more embodiments disclosed.

FIG. 1 depicts an illustrative downhole tool 100 for removing a segment of a casing in a wellbore, according to one or more embodiments. The downhole tool 100 may include a jet sub 110, one or more section mills (two are shown 120, 140), one or more stabilizers (three are shown 130, 150, 170), and/or a taper mill 180.

The jet sub 110 may have a bore formed axially therethrough. One or more openings 112 may extend radially through the jet sub 110. The openings 112 may allow a fluid to flow from the bore of the jet sub 110 to an annulus formed between an exterior of the jet sub 110 and the casing and/or wellbore wall. The openings 112 may include a carbide jet sleeve proximate the outer surface of the jet sub 110. The openings 112 may be oriented at an angle with respect to a longitudinal axis through the jet sub 110. More particularly, the portion of the openings 112 proximate the inner surface of the jet sub 110 may be positioned above the portion of the openings 112 proximate the outer surface of the jet sub 110 such that fluid flows in a generally downward direction from the bore, through the openings 112, and into the annulus. For example, the angle may range from a low of about 10°, about 20°, or about 30° to a high of about 60°, about 70°, or about 80° with respect to vertical.

As used herein, the terms "inner" and "outer"; "up" and "down"; "upper" and "lower"; "upward" and "downward"; "above" and "below"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

A first section mill or "extended duration" section mill 120 may be coupled to the lower end portion of the jet sub 110. The first section mill 120 may have a bore formed axially therethrough that is in fluid communication with the bore formed through the jet sub 110. One or more cutters or blades (three are shown 210, 220, 230; one is obscured 240) may be coupled to the first section mill 120. For example, the number of blades 210, 220, 230, 240 may range from a low of about 1, 2, 3, or 4 to a high of about 6, 8, 10, 12, or more. The blades 210, 220, 230, 240 may be circumferentially and/or axially offset on the first section mill 120. The blades 210, 220, 230, 240 may be adapted to move or pivot radially outward toward the casing in the wellbore. The blades 210, 220, 230, 240 may be shaped, sized, and dressed to remove an extended section of the casing. The first section mill 120 is discussed in more detail below with reference to FIGS. 2-5.

A first stabilizer 130 may be coupled to the lower end portion of the first section mill 120. The first stabilizer 130 may have a bore formed axially therethrough that is in fluid communication with the bores formed through the jet sub 110 and the first section mill 120. One or more blades (three are shown 132, 134, 136) may be coupled to or integrated with an outer surface of the first stabilizer 130. The blades 132, 134, 136 may be straight or spiraled (as shown). The blades 132, 134, 136 may be made of a hard metal, such as steel. Further, the blades 132, 134, 136 may be coated with a hardfacing material, such as tungsten carbide or the like. The first stabilizer 130 may be adapted to mechanically stabilize the first section mill 120 and/or the downhole tool 100 within the casing to avoid unintentional sidetracking and/or lateral vibrations. For example, the first stabilizer 130 may be adapted to maintain a longitudinal centerline through the first section mill 120 and/or the downhole tool 100 in alignment with a longitudinal centerline through the casing.

A second section mill 140 may be coupled to the lower end portion of the first stabilizer 130. The second section mill 140 may be the same as the first section mill 120, i.e., an "extended duration" section mill, or the second section mill 140 may be another type of section mill known to those skilled in the art. The second section mill 140 may have a bore formed at least partially therethrough that is in fluid communication with the bores formed through the jet sub 110, the first section mill 120, and the first stabilizer 130. One or more cutters or blades (three are shown 310, 320, 330; one is obscured 340) may be coupled to the second section mill 140. For example, the number of blades 310, 320, 330, 340 may range from a low of about 1, 2, 3, or 4 to a high of about 6, 8, 10, 12, or more. The blades 310, 320, 330, 340 may be circumferentially and/or axially offset on the second section mill 140. The blades 310, 320, 330, 340 may be adapted to move or pivot radially outward toward the casing in the wellbore. The blades 310, 320, 330, 340 may be shaped, sized, and dressed to first initiate the cut and subsequently remove a section of the casing. The second section mill 140 is discussed in more detail below with reference to FIGS. 6 and 7.

A second stabilizer 150 may be coupled to the lower end portion of the second section mill 140. The second stabilizer 150 may be the same as the first stabilizer 130, or the second stabilizer 150 may be another type of section mill known to those skilled in the art. The second stabilizer 150 may be adapted to mechanically stabilize the second section mill 140 and/or the downhole tool 100 within the casing to avoid unintentional sidetracking and vibrations. For example, the second stabilizer 150 may be adapted to maintain a longitudinal centerline through the second section mill 140 and/or the downhole tool 100 in alignment with a longitudinal centerline through the casing.

A tail pipe 160 may be coupled to the lower end portion of the second stabilizer 150. The tail pipe 160 may be a blank section of pipe having a length ranging from a low of about 1 m, about 2 m, or about 3 m to a high of about 10 m, about 20 m, about 30 m, or more.

A third stabilizer 170 or a taper mill 180 may be coupled to the lower end portion of the tail pipe 160. When the casing is cut into two axially offset segments, e.g., upper and lower segments, the third stabilizer 170 or the taper mill 180 may be disposed within the lower segment of the casing to mechanically stabilize the downhole tool 100 within the lower segment of the casing to avoid unintentional sidetracking and vibrations. For example, the third stabilizer 170 or the taper mill 180 may be adapted to maintain a longitudinal centerline through the downhole tool 100 in alignment with a longitudinal centerline through the lower segment of the casing.

Figure 2:
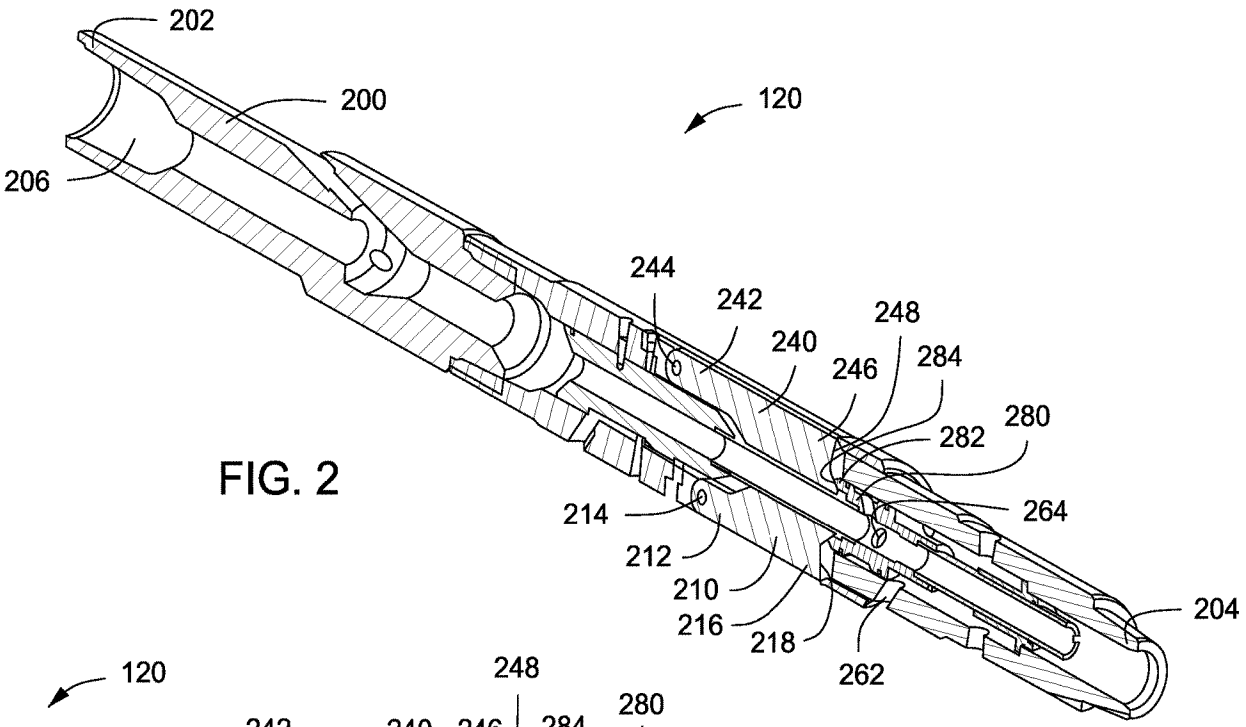
FIG. 2 depicts a partial perspective view of an illustrative first section mill in an inactive position, according to one or more embodiments disclosed.
Figure 3:
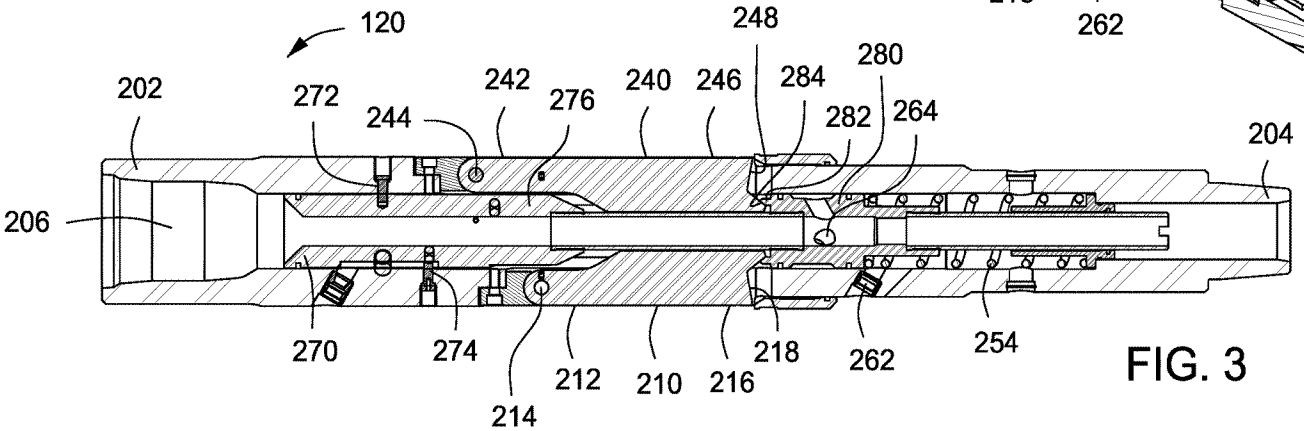
FIG. 3 depicts a cross-sectional view of the first section mill in the inactive position, according to one or more embodiments disclosed.

FIG. 2 depicts a partial perspective view of the first section mill 120 in an inactive position, and FIG. 3 depicts a cross-sectional view of the first section mill 120 in the inactive position, according to one or more embodiments. The first section mill 120 includes an annular body 200 with a first or "upper" end portion 202 and a second or "lower" end portion 204. A bore 206 may extend through the body 200 and provide a path of fluid communication from the first end portion 202 to the second end portion 204.

The blades 210, 240 (blades 220, 230 not shown) are coupled to the body 200 of the first section mill 120. For example, a first end portion 212, 242 of each blade 210, 240 may be movably coupled to the body 200 with a hinge pin 214, 244 or other coupling device known to those skilled in the art which permits the blade 210, 240 to pivot relative to the body 200. A second end portion 216, 246 of each blade 210, 240 may have a cutting surface 218, 248 formed or disposed thereon. The cutting surfaces 218, 248 may be adapted to cut, grind, or otherwise mill the casing, as described in more detail below. The same disclosure herein with respect to first and second blades 210, 240 equally applies to the other blades, e.g., 220, 230, of the first section mill 120.

While the second end portions 216, 246 of the blades 210, 240 may be axially adjacent to one another, the first end portions 212, 242 of the blades 210, 240 may be axially offset from one another. This may prevent the hinge pins 214, 244 from intersecting or otherwise interfering with one another. As such, the blades 210, 240 may have different lengths, as shown.

The first and second blades 210, 240 in FIGS. 2 and 3 are shown in an inactive position. In the inactive position, the second end portions 216, 246 of the blades 210, 240, and the cutting surfaces 218, 248 formed thereon, are folded into the body 200 of the first section mill 120 such that an outer surface of the blades 210, 240 is aligned with an outer surface of the body 200. Accordingly, the blades 210, 240 are not capable of cutting, grinding, or otherwise milling the casing in the inactive position.

The first and second blades 210, 240 may be secured in the inactive position via engagement with one or more axial protrusions 282 extending from a first piston 280 in the body 200. The axial protrusions 282 may include a sloped surface 284. The sloped surface 284 may be oriented at an angle with respect to a longitudinal centerline through the first section mill 120. The angle may be from about 0° (parallel with the centerline) to about 10°, about 10° to about 30°, about 30° to about 45°, about 45° to about 60°, or about 60° to about 80°. The sloped surface 284 may be arranged and designed to mate with, abut, or otherwise contact the cutting surfaces 218, 248 of the first and second blades 210, 240 to secure the first and second blades 210, 240 in the inactive position.

Figure 4:
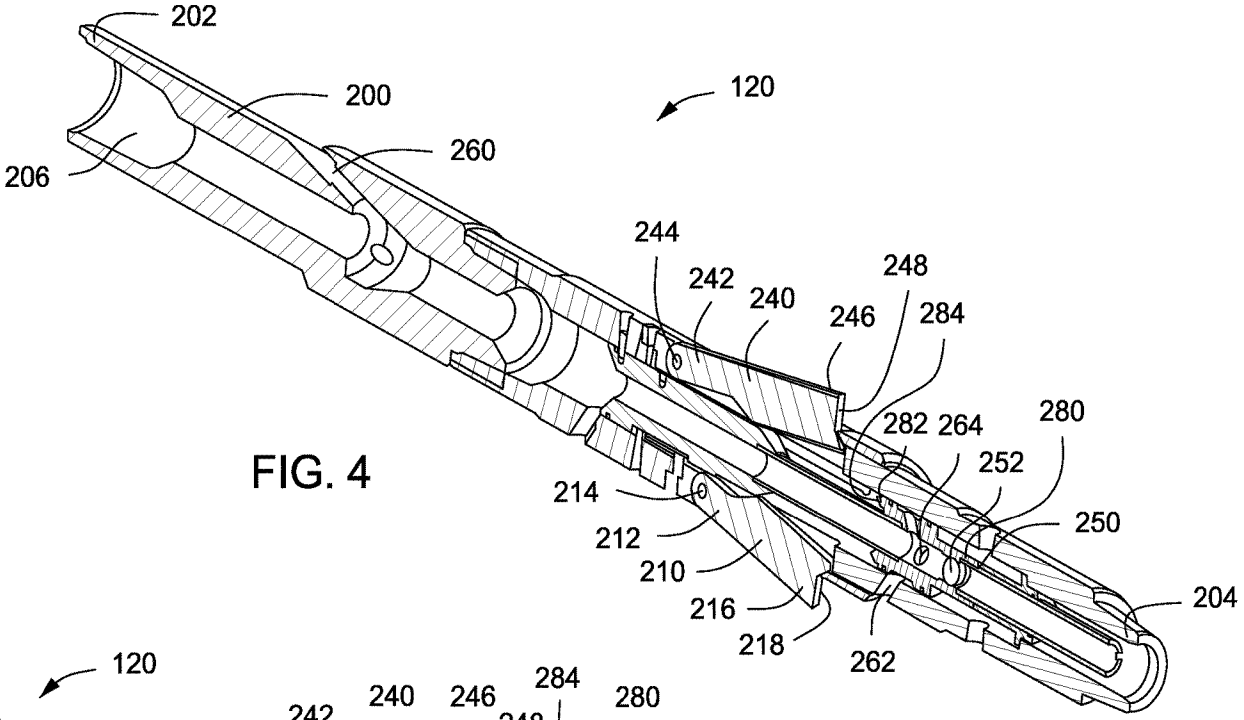
FIG. 4 depicts a partial perspective view of the first section mill in an active position, according to one or more embodiments disclosed.
Figure 5:
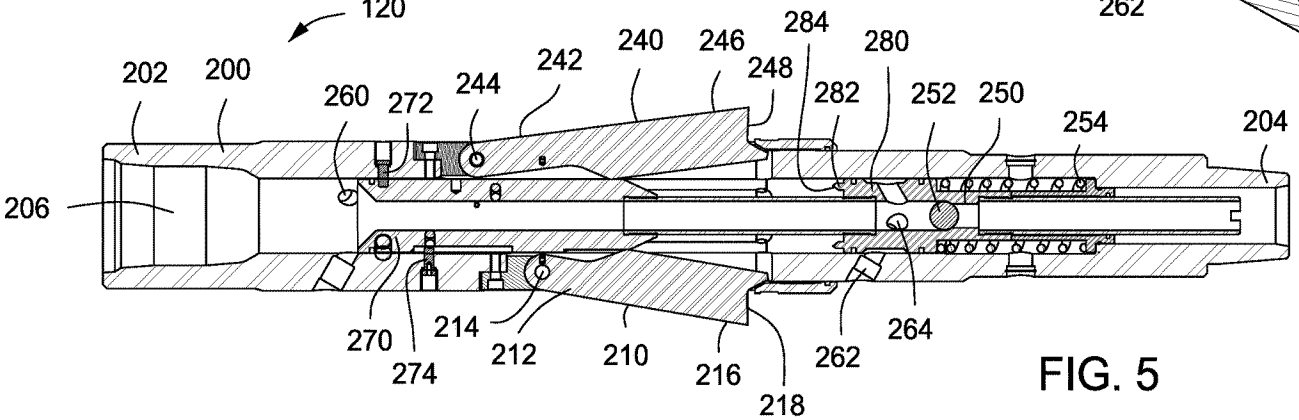
FIG. 5 depicts a cross-sectional view of the first section mill in the active position, according to one or more embodiments disclosed.

FIG. 4 depicts a partial perspective view of the first section mill 120 in an active position, and FIG. 5 depicts a cross-sectional view of the first section mill 120 in the active position, according to one or more embodiments. The first section mill 120 may include a seat or "ball seat" 250 formed therein. For example, the seat 250 may be a transition or shoulder formed by a decrease in the diameter of the bore 206. The seat 250 may be positioned between the blades 210, 240 and the second end portion 204 of the body 200.

The seat 250 may be adapted to receive an impediment 252 that enters the bore 206 of the first section mill 120 through the first end portion 202 thereof. The impediment 252 may be a ball, a dart, or the like. For example, the impediment 252 may be a steel ball. The impediment 252 is arranged and designed to form a fluid tight seal against the seat 250 enabling one-way fluid flow through the bore 206. More particularly, fluid may flow through the bore 206 from the second end portion 204 toward the first end portion 202 (i.e., upward); however, fluid flowing through the bore 206 from the first end portion 202 toward the second end portion 204 (i.e., downward) may be directed out into the annulus via ports 260, 262, as explained in more detail below.

When the impediment 252 is received and seated in the seat 250, the bore 206 is blocked, and the pressure of the fluid in the bore 206 above the ball 252 begins to increase. The pressure of the fluid in bore 206 increases to a point which causes the first piston 280 and a second piston 270 to move toward the second end portion 204 (i.e., downward), thereby shearing shear pins 272, 274 and compressing a spring 254. When the first piston 280 moves a predetermined distance, the axial protrusions 282 (if present) may disengage and become axially offset from the cutting surfaces 218, 248 of the first and second blades 210, 240. A cam or wedge 276 on the second piston 270 may then move or pivot the blades 210, 240 (and also blades 220, 230) outwardly about the hinge pins 214, 244 into an active position. In the active position, the second end portions 216, 246 of the blades 210, 240, and the cutting surfaces 218, 248 formed thereon, are positioned radially outward from the outer surface of the body 200 of the first section mill 120. Accordingly, the blades 210, 240 (and blades 220, 230) are adapted to cut, grind, or mill the casing (which is disposed radially outward from the body 200 of the first section mill 120) in the active position.

One or more openings or ports 260, 262 may be formed radially through the body 200. A first opening 260 may be disposed proximate the first end portion 202 of the body 200. For example, the first opening 260 may be disposed between the first end portion 202 of the body 200 and the blades 210, 240. When the piston 270 is moved downwardly as shown in FIGS. 4 and 5 (and as disclosed above), the first opening 260 is exposed and provides a path for fluid to travel between bore 206 and the annulus formed between the outer surface of the body 200 and the casing and/or wellbore wall. A second opening or port 262 may be disposed proximate the second end portion 204 of the body 200. For example, the second opening 262 may be disposed between the second end portion 204 of the body 200 and the blades 210, 240 and/or the seat 250. When the piston 270 is moved downwardly as shown in FIGS. 4 and 5, an opening 264 in the wall of piston 270 may come into axial alignment with the second opening 262 and provide a path for fluid to travel between bore 206 and the annulus formed between the outer surface of the body 200 and the casing and/or wellbore wall.

As the blades 210, 240 actuate back into the inactive position by folding inward, the first and second pistons 280, 270 may move toward the second end portion 204, once again compressing the spring 254. After the blades 210, 240 have moved inward, the first and second pistons 280, 270 may move back toward the first end portion 202, and the sloped surfaces 284 of the axial protrusions 282 (if present) may reengage the corresponding cutting surfaces 218, 248 of the first and second blades 210, 240 to secure the first and second blades 210, 240 in the inactive position.

Figure 6:
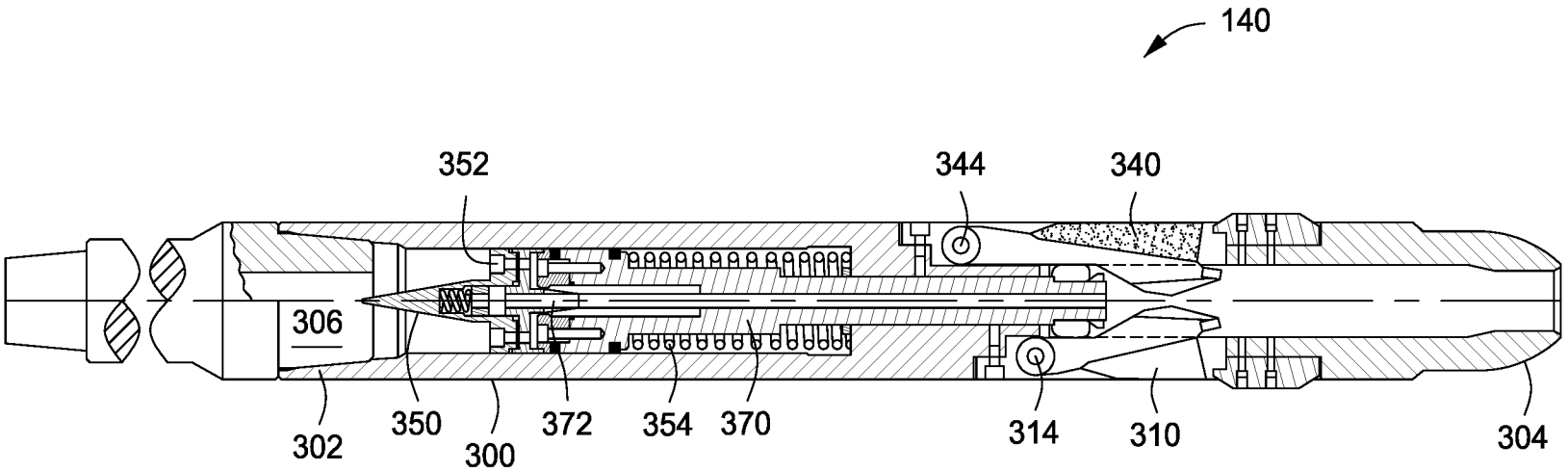
FIG. 6 depicts a cross-sectional view of an illustrative second section mill in an inactive position, according to one or more embodiments disclosed.
Figure 7:
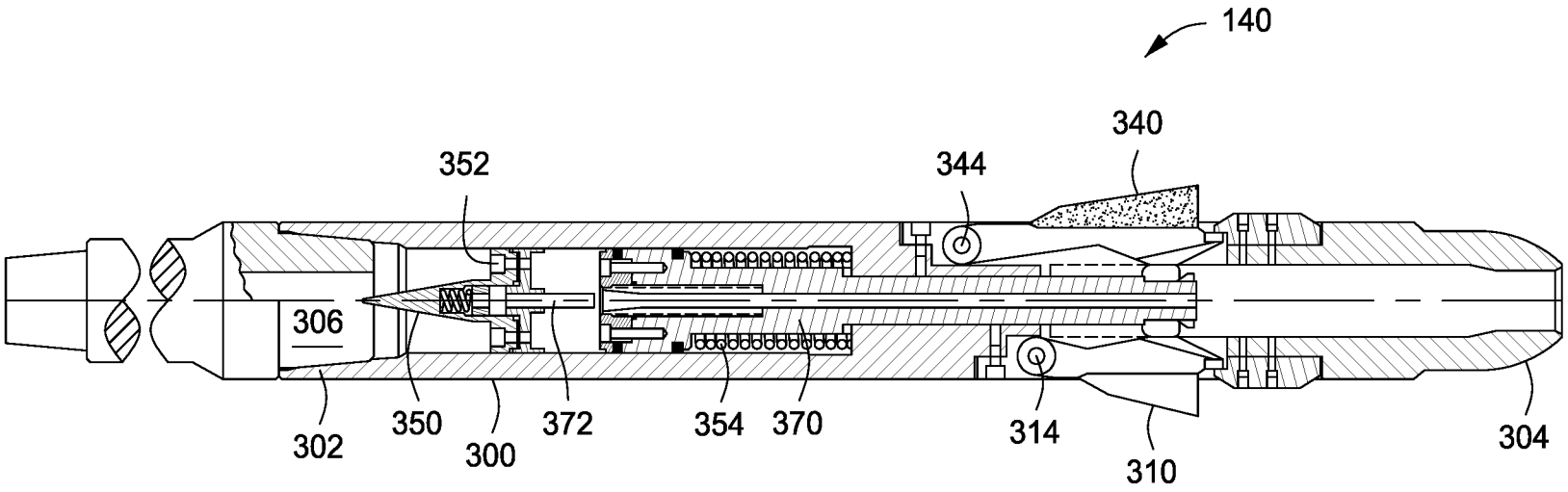
FIG. 7 depicts a cross-sectional view of the second section mill in an active position, according to one or more embodiments disclosed.

FIG. 6 depicts a cross-sectional view of the second section mill 140 in an inactive position, and FIG. 7 depicts a cross-sectional view of the second section mill 140 in an active position, according to one or more embodiments. The second section mill 140 includes a body 300 with a first or "upper" end portion 302 and a second or "lower" end portion 304. A bore 306 extends through the body 300, but as will be disclosed in greater detail below, is occluded when the second section mill 140 is in its inactive position.

The blades 310, 340 (blades 320, 330 not shown) may be movably coupled to the body 300 of the second section mill 140 via hinge pins 314, 344 or other coupling devices known to those skilled in the art which permits the blade 310, 340 to pivot relative to the body 300. The blades 310, 340 may be generally similar to the blades 210, 240 of the first section mill 120 described above. The first and second blades 310, 340 of the second section mill 140 are shown in an inactive position in FIG. 6 and in an active position in FIG. 7. In the inactive position, the blades 310, 340 are not capable of cutting, grinding, or otherwise milling the casing. The same disclosure herein with respect to blades 310, 340 equally applies to the other blades, e.g., 320, 330, of the second section mill 140.

Rather than a ball seat 250 (as shown in FIGS. 2-5), the second section mill 140 may include a valve such as the FLO-TEL® assembly 350 manufactured and sold by Schlumberger Limited. As best shown in FIG. 7, the FLO-TEL® assembly 350 is adapted to permit fluid flow through openings 352 and around a stinger 372 to move a piston 370 axially within the bore 306 in response to an increased pressure of the fluid in the bore 306. When the pressure of the fluid in the bore increases to a predetermined level, the piston 370 moves or actuates, thereby causing the blades 310, 340, which are couple thereto, to move or pivot into the active position. The first section mill 120 may alternatively have a valve, such as the FLO-TEL® assembly 350 disclosed above, rather than a ball seat 250. Such a valve in the first section mill 120 may be arranged and designed to be responsive to a different (e.g., higher) bore fluid pressure than the valve of the second section mill 140 in order to permit independent actuation of the first and second section mills 120, 140. In one or more embodiments, the second section mill 140 may have an arrangement (not shown), e.g., ball seat 250, first/second pistons 270, 280, shear pins 272, 274 and spring 254, similar to that disclosed with respect to first section mill 120. Such arrangement may have a ball seat which is smaller in size to seat a smaller ball. Accordingly, the smaller ball is arranged and designed to pass through the ball seat 250 of the first section mill 120.

Figure 8:
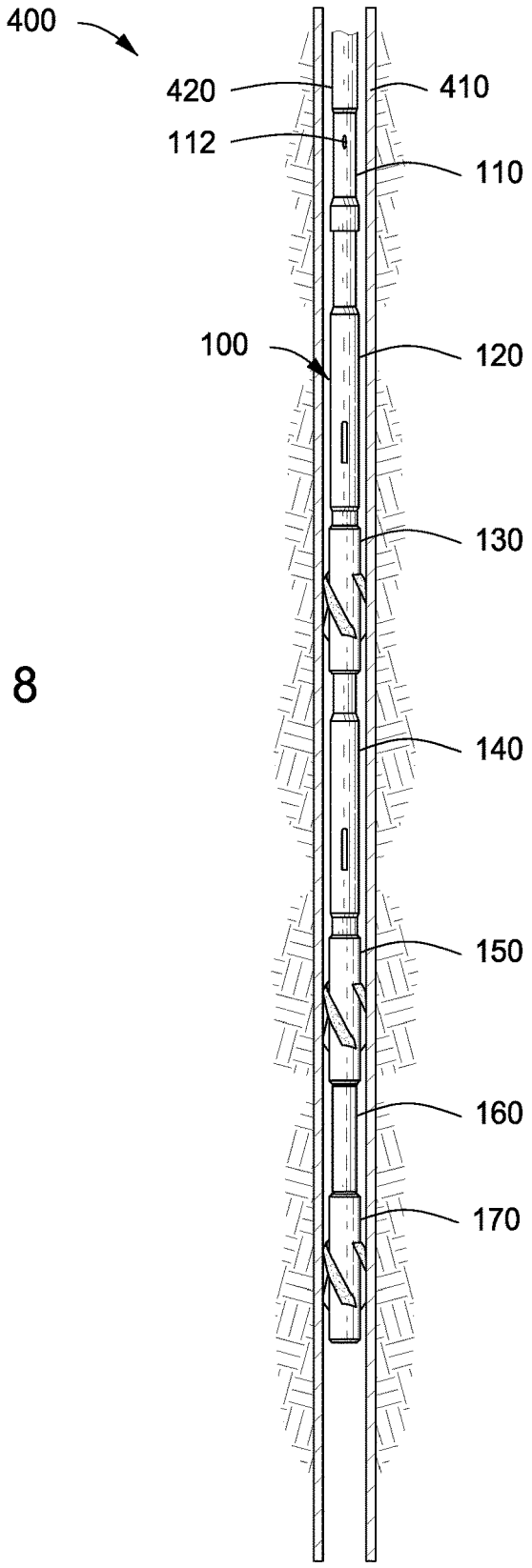
FIG. 8 depicts the downhole tool disposed within the casing of a wellbore, according to one or more embodiments disclosed.

FIGS. 8-13 depict an exemplary process for removing a segment of a casing 410 in a wellbore 400. More particularly, FIG. 8 depicts the downhole tool 100 disposed within the casing 410 of the wellbore 400, according to one or more embodiments. In operation, the downhole tool 100 is run into the wellbore 400 with a tool string 420 to the desired depth. As the downhole tool 100 is being run into the wellbore 400, the blades 210, 220, 230, 240, 310, 320, 330, 340 on the first and second section mills 120, 140 may be in the inactive, i.e., folded-in, position.

Figure 9:
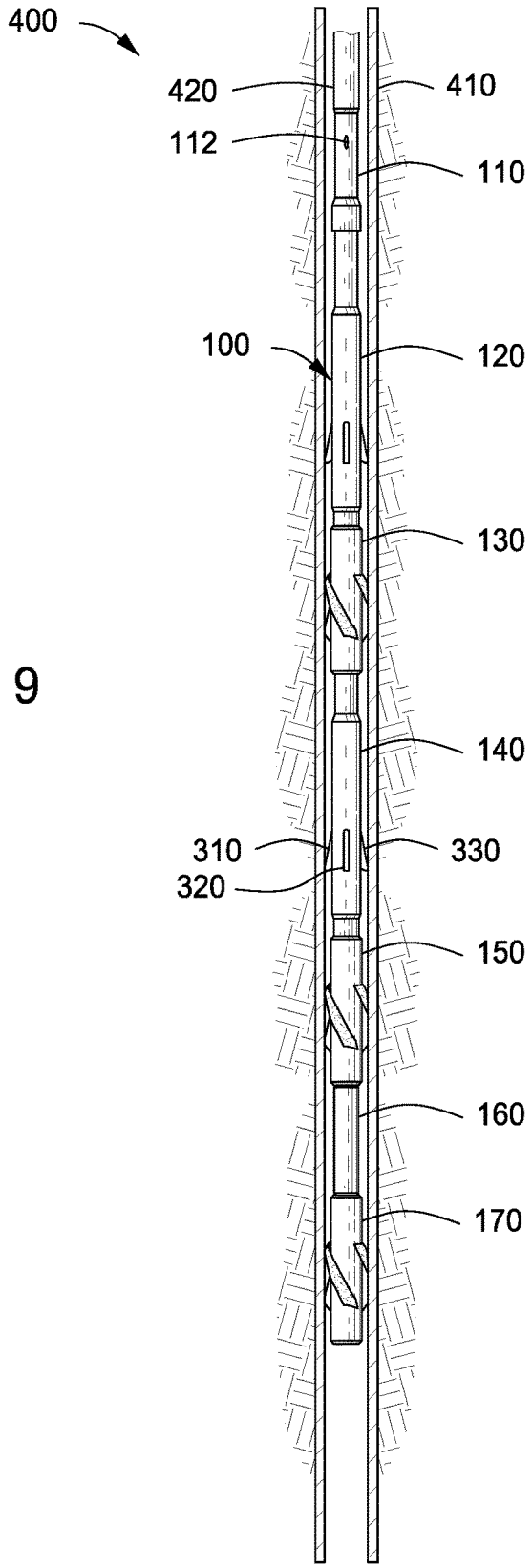
FIG. 9 depicts the blades of the second section mill in the active position, according to one or more embodiments disclosed.

FIG. 9 depicts the blades 310, 320, 330, 340 (340 not shown in FIGS. 9-11) of the second section mill 140 in the active position, according to one or more embodiments. Once the downhole tool 100 reaches the desired depth, pressure may be applied to the tool string 420 from the surface via a pumped fluid. When the pressure reaches a predetermined level within the downhole tool 100, piston 370 (see FIGS. 6 and 7) in the second section mill 140 actuates the blades 310, 320, 330, 340 of the second section mill 140 into the active position such that they are in contact with the casing 410.

Figure 10:
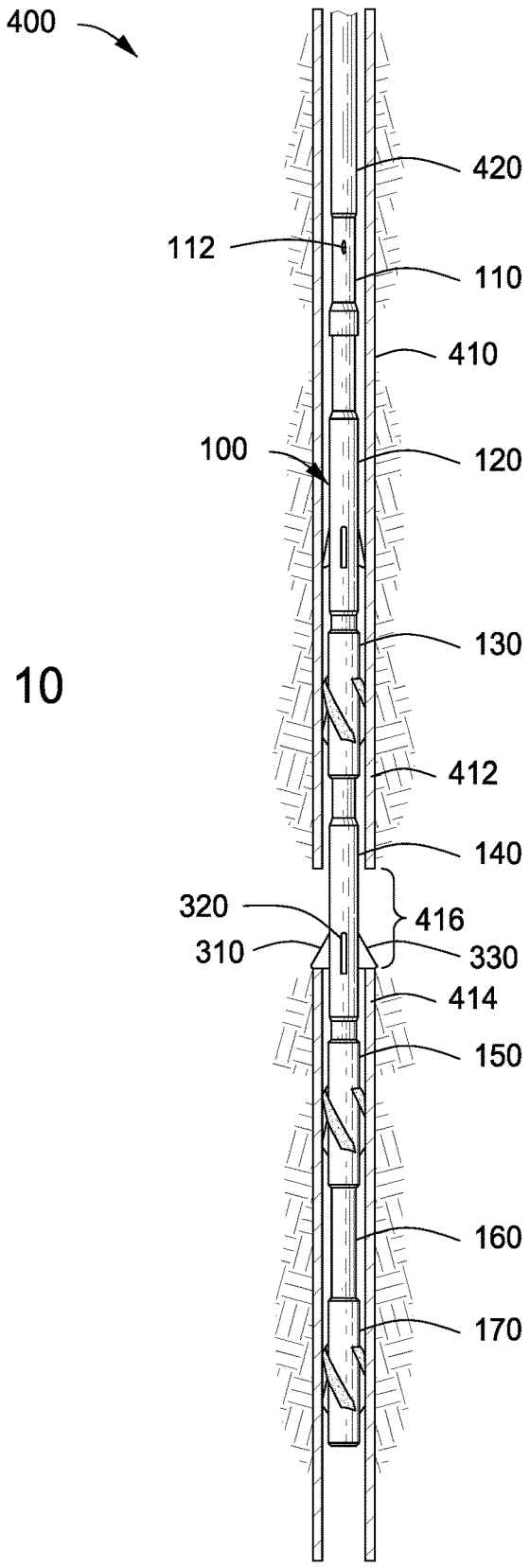
FIG. 10 depicts the blades of the second section mill milling the casing into a first or "upper" segment and a second or "lower" segment, according to one or more embodiments disclosed.

FIG. 10 depicts the blades 310, 320, 330, 340 of the second section mill 140 milling the casing 410 into a first or "upper" segment 412 and a second or "lower" segment 414, according to one or more embodiments. The tool string 420 and downhole tool 100 may be rotated in any manner known to those skilled in the art, thereby causing the blades 310, 320, 330, 340 to cut through the casing 410. Once the blades 310, 320, 330, 340 have cut through the casing 410, the tool string 420 may gradually lower the downhole tool 100 within the wellbore 400. As the downhole tool 100 moves downward, the blades 310, 320, 330, 340 of the second section mill 140 grind or mill the casing 410 to remove a portion thereof, thereby forming the first or "upper" segment 412 and the second or "lower" segment 414 with a removed portion or "axial gap" 416 disposed therebetween. In at least one embodiment, the length of the axial gap 416 created by the second section mill 140 may range from a low of about 5 m, about 10 m, or about 15 m to a high of about 20 m, about 30 m, about 40 m, or more.

Figure 11:
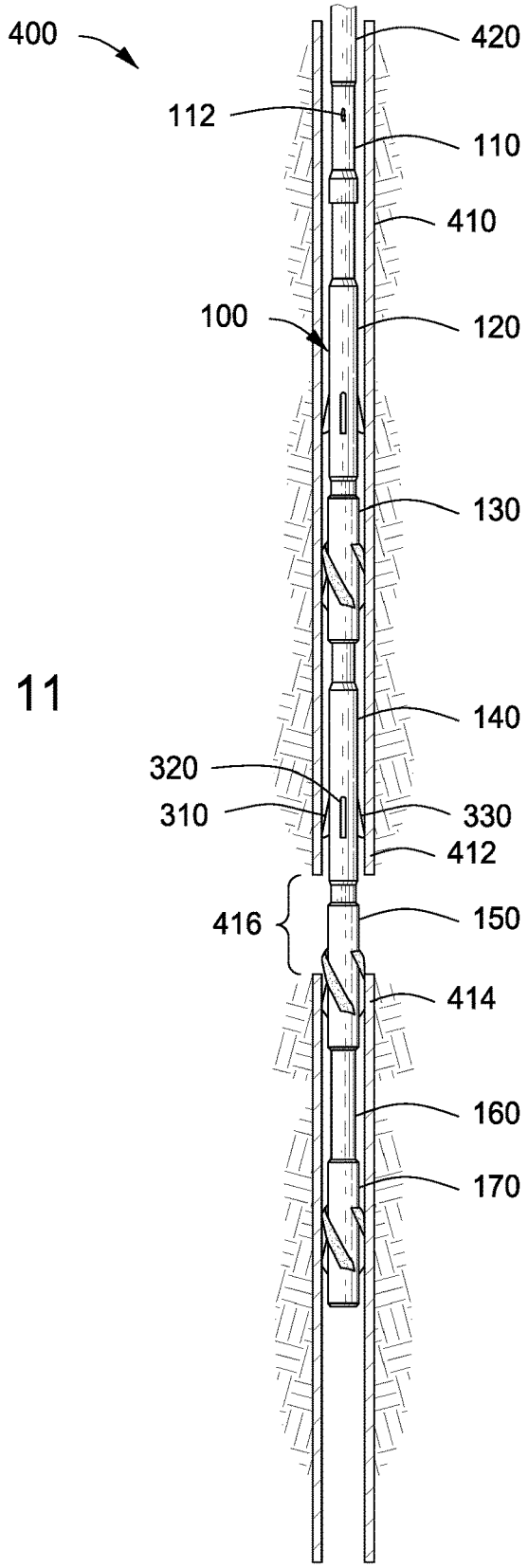
FIG. 11 depicts the blades of the second section mill retracting into the inactive position, according to one or more embodiments disclosed.

FIG. 11 depicts the blades 310, 320, 330, 340 of the second section mill 140 retracting into the inactive position, according to one or more embodiments. In at least one embodiment, milling the casing 410 causes the blades 310, 320, 330, 340 of the second section mill 140 to become worn down and less effective. As such, an operator at the surface may retract the blades 310, 320, 330, 340 of the second section mill into the inactive position. To retract the blades 310, 320, 330, 340, the pressure applied to the tool string 420 may be decreased. As the pressure decreases, spring 354 (see FIGS. 6 and 7) biases the blades 310, 320, 330, 340 from the active position to the inactive position.

To ensure that the blades 310, 320, 330, 340 retract into the inactive position, the tool string 420 may be pulled upward, thereby pulling the downhole tool 100 upward within the wellbore 400. As the blades 310, 320, 330, 340 contact the first segment 412 of the casing 410, the first segment 412 applies a downward force on the outer surface of the blades 310, 320, 330, 340 causing them to rotate about the hinge pins 314, 344 and into the inactive position. As this occurs, the tail pipe 160 may be long enough so that the third stabilizer 170 (as shown) or the taper mill 180 (see FIG. 1) remains disposed within the second segment 414 of the casing 410. This ensures that the downhole tool 100 is properly aligned within the second segment 414 of the casing 410 when the downhole tool 100 is lowered within the wellbore 400 again.

Figure 12:
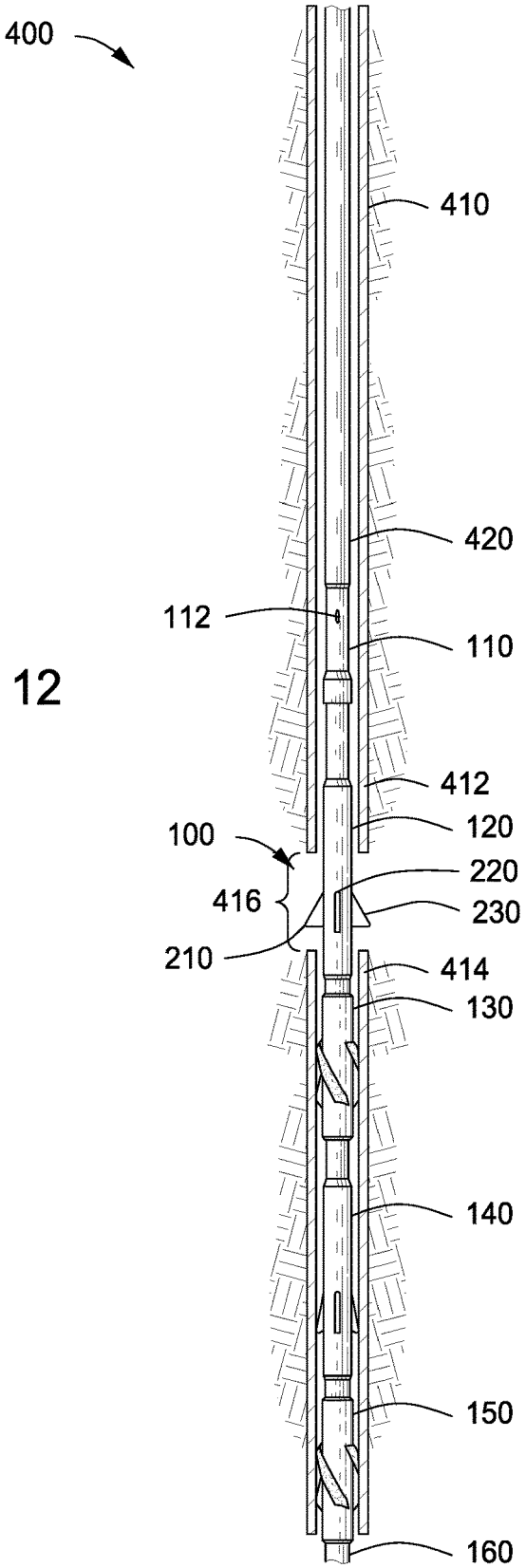
FIG. 12 depicts the blades of the first section mill in the active position, according to one or more embodiments disclosed.

FIG. 12 depicts the blades 210, 220, 230, 240 (240 not shown in FIGS. 12 and 13) of the first section mill 120 in the active position, according to one or more embodiments. The first section mill 120 may be used to increase the length of the axial gap 416 between the first and second segments 412, 414. Once the blades 310, 320, 330, 340 of the second section mill 140 have actuated to their inactive position, the tool string 420 may lower the downhole tool 100 to a position in the wellbore 400 where the first section mill 120 is aligned with the axial gap 416 in the casing 410.

An impediment 252 may then be inserted into the tool string 420 from an operator at the surface. The impediment 252 travels through the through-bore of the tool string 420 and into the downhole tool 100 where it comes to rest against the seat 250 in the first section mill 120 forming a fluid tight seal therewith. Pressure may then be applied to the fluid in the through-bore of the tool string 420 from the surface via a pumped fluid. Due to the seal, the pressure will continue to rise up to the level where it exceeds the collective resistance of the shear pins 272, 274. This pressure level may range from a low of about 6 MPa, about 8 MPa, or about 10 MPa to a high of about 12 MPa, about 14 MPa, about 16 MPa, or more. This higher pressure causes shear pins 272, 274 within the first section mill 120 to shear, thereby permitting the piston 270 to be moved downward. Downward movement of the piston 270 moves or pivots the blades 210, 220, 230, 240 outwardly into an active position (via cam or wedge 276) and provides a path of fluid communication between the bore 206 of the first section mill 120 and the exterior of the first section mill 120 via the openings 260 and/or 262, as previously disclosed. Such fluid communication between the bore 206 and the annulus causes the pressure in the bore 206 to drop to a level ranging from a low of about 1 MPa, about 1.5 MPa, or about 2 MPa to a high of about 2.5 MPa, about 3 MPa, about 3.5 MPa, or more. This lower pressure maintains the actuation of the blades 210, 220, 230, 240 of the first section mill 120 in their active position, as shown in FIG. 12.

Figure 13:
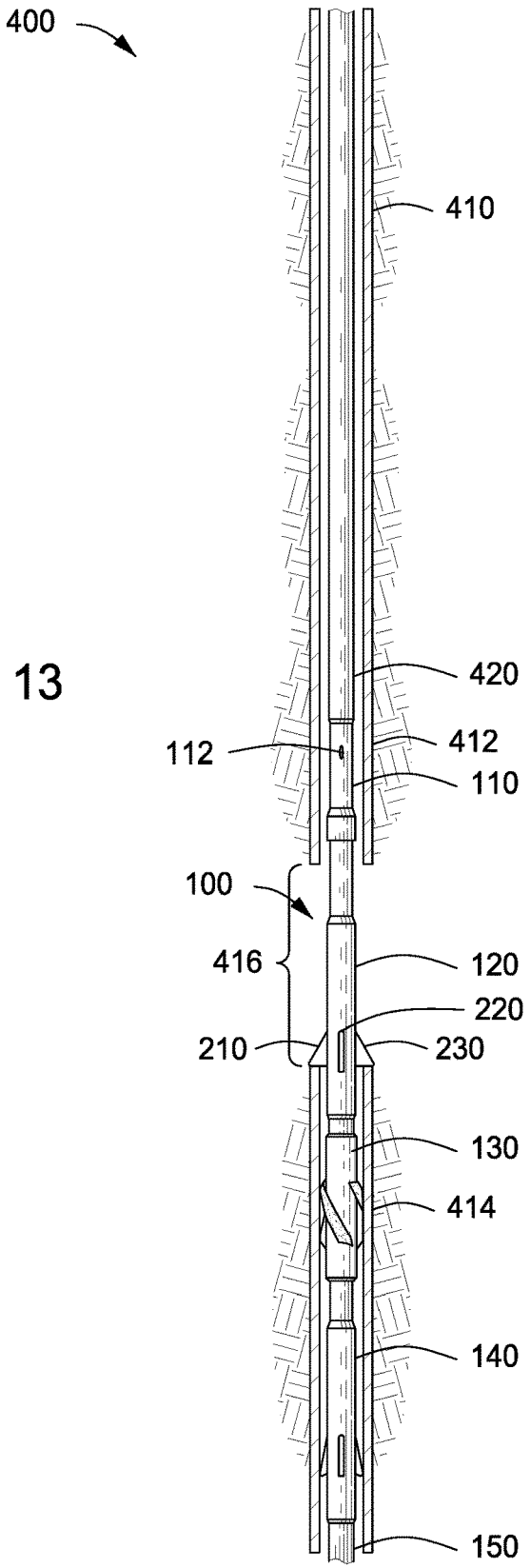
FIG. 13 depicts the first section mill milling the casing to increase the length of the axial gap between the first and second segments of the casing, according to one or more embodiments disclosed.

FIG. 13 depicts the first section mill 120 milling the casing 410 to increase the length of the axial gap 416 between the first and second segments 412, 414 of the casing 410, according to one or more embodiments. The tool string 420 may then lower the downhole tool 100 within the wellbore 400 until the blades 210, 220, 230, 240 of the first section mill 120 contact the upper end portion of the second segment 414. The tool string 420 may then continue to gradually lower the downhole tool 100 within the wellbore 400. The rotation of the downhole tool 100 causes the blades 210, 220, 230, 240 to grind or mill the second segment 414 of the casing 410, thereby increasing the length of the axial gap 416 in the casing 410.

In at least one embodiment, the length of the axial gap 416 in the casing 410 removed by the first section mill 120 may range from a low of about 5 m, about 10 m, or about 15 m to a high of about 20 m, about 30 m, about 40 m, or more. Thus, the length of the axial gap 416 in the casing 410 created by the first and second section mills 120, 140 may range from a low of about 10 m, about 20 m, or about 30 m to a high of about 50 m, about 75 m, about 100 m, about 125 m, or more. In addition, one or more additional first section mills (not shown) may be coupled to or integrated with the downhole tool 100 and used to further increase the length of the axial gap 416 in the casing 410.

When the desired length of the axial gap 416 in the casing 410 is reached, or the blades 210, 220, 230, 240 of the first section mill 120 become worn down, the operator may decrease the pressure of the fluid applied from the surface. As the pressure of the fluid in the bore 206 of the first section mill 120 decreases, the one or more springs 254 may actuate the blades 210, 220, 230, 240 from the active position to the inactive position. The tool string 420 may then be pulled upwardly, thereby pulling the downhole tool 100 upward and out of the wellbore 400. If the desired axial gap length has been achieved, cement may then be introduced into the openhole portion of the wellbore 400, i.e., between the first and second segments 412, 414 of the casing 410, to form a plug or barrier above a previously installed bridge plug. Once the cement plug is in place, the wellbore 400 may be considered abandoned.

Although only a few example embodiments have been described in detail above, those skilled in the art will readily appreciate that many modifications are possible in the example embodiments without materially departing from "Extended Duration Section Mill and Methods of Use." For instance, in several of the Figures, the first section mill 120 is shown positioned above the second section mill 140; however, those skilled in the art will appreciate that in one or more embodiments the second section mill 140 may be positioned above the first section mill 120. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function or other functional claiming for any limitations of any of the claims herein, except for those in which the claim expressly uses the words 'means for' together with an associated function.

What is claimed is:

1. A section mill for removing a portion of a casing in a wellbore, comprising:

a body having a first end portion and a second end portion, the first end portion being an uphole end portion and the second end portion being a downhole end portion;

a plurality of blades each having a first end portion and a second end portion, the first end portion of each blade being movably coupled to the body, and the second end portion of each blade having a cutting surface thereon;

a seat within the body and positioned axially between the plurality of blades and the downhole end portion of the body, the plurality of blades being adapted to actuate from an inactive position to an active position in response to an impediment forming a seal against the seat, the seat being adapted to receive the impediment when the impediment travels from the uphole end portion toward the downhole end portion, and the plurality of blades being adapted to actuate to the active position while the impediment remains seated on the seat; and a first piston within the body, the first piston including one or more axial protrusions at a first end thereof and which selectively secure the plurality of blades in the inactive position via engagement with the second end of the plurality of blades.

2. The section mill of claim 1, further comprising the impediment within the body and against the seat.

3. The section mill of claim 1, the seat being positioned axially between the second end portions of the plurality of blades and the downhole end portion of the body.

4. The section mill of claim 1, further comprising a second piston within the body and a cam coupled to at least the second piston and adapted to be moved axially within the body by at least the second piston.

5. The section mill of claim 4, the plurality of blades being adapted to actuate from the inactive position to the active position in response to the first piston moving and disengaging the one or more axial protrusions from the plurality of blades and the cam moving axially within the bore and engaging the plurality of blades.

6. The section mill of claim 5, the cam being movable in response to a fluid pressure increase moving at least the second piston in response to the impediment entering the body through the first end portion, moving axially past the second piston, and forming a seal against the seat.

7. The section mill of claim 1, further comprising at least one radial opening formed in the body and providing a path of fluid communication between a bore within the body and an outer surface of the body.

8. A downhole tool for removing a portion of a casing in a wellbore, comprising:

a first section mill having a body with a first end portion, a second end portion, and a first axial bore formed therethrough, the first section mill including:

a first plurality of blades each having opposing first and second end portion, the first end portion of each of the first plurality of blades being movably coupled to the body of the first section mill, and the second end portion of each of the first plurality of blades has a cutting surface thereon;

a first piston located within the first axial bore and movable within the first axial bore in response to fluid pressure in the first axial bore;

a second piston located within the first axial bore and being coupled to a cam that is moved axially within the first axial bore by the second piston and in response to fluid pressure in the first axial bore, the second piston being positioned axially between the first piston and the first end portion of the first section mill; and a seat within the first bore and coupled to the first piston, the first plurality of blades being adapted to actuate from an inactive position to an active position in response to the cam moving axially within the first axial bore to engage the first plurality of blades, the second piston being adapted to move the cam in response to a fluid pressure change resulting from an impediment moving within the body away from the second piston and toward the first piston until forming a seal against the seat, the plurality of blades being adapted to actuate to the active position while the impediment remains seated on the seat; and a second section mill axially below the first section mill, the second section mill having a body with a first end portion, a second end portion, and a second axial bore formed at least partially therethrough, the second axial bore being in fluid communication with the first axial bore, and the second section mill including:

a second plurality of blades each having a first end portion and a second end portion, the first end portion of each of the second plurality of blades being moveably coupled to the body of the second section mill, and the second end portion of each of the second plurality of blades having a cutting surface thereon; and at least a third piston in the second axial bore, the third piston being movable within the second axial bore in response to fluid pressure in the second axial bore to move the second plurality or blades from an inactive position to an active position.

9. The downhole tool of claim 8, further comprising a jet sub coupled to the first end portion of the first section mill, the jet sub including a third axial bore formed therethrough that is in fluid communication with the first and second axial bores, at least one radial opening forming a path of fluid communication between the third axial bore and an outer surface of the jet sub.

10. The downhole tool of claim 8, further comprising a stabilizer axially between the second end portion of the first section mill and the first end portion of the second section mill.

11. The downhole tool of claim 8, further comprising a first stabilizer axially between the second end portion of the first section mill and the first end portion of the second section mill, and a second stabilizer axially below the second end portion of the second section mill.

12. The downhole tool of claim 8, further comprising a valve within the second bore, the second plurality of blades being adapted to actuate from the inactive position to the active position in response to movement of the valve.

13. The downhole tool of claim 8, wherein the first and second plurality of blades being shaped, sized, and dressed to cut casing.

14. A method for removing a portion of a casing in a wellbore, comprising:

running a downhole tool into the wellbore, the downhole tool including:

a first section mill having:

a first body having opposing first and second end portions, and a first axial bore extending between the first and second end portions;

a first plurality of blades each having a first end portion and a second end portion, the first end portion of each of the first plurality of blades being movably coupled to the first body, and the second end portion of each of the first plurality of blades having a cutting surface thereon; and first and second pistons within the first axial bore, the second piston including or being coupled to a blade engagement feature for engaging the first plurality of blades, and the first piston being coupled to a seat formed within the first axial bore, wherein the first plurality of blades are adapted to actuate from a first inactive position to a first active position in response to an impediment moving away from the second piston and toward the first piston until forming a seal against the seat, and remaining seated on the seat, thereby allowing fluid pressure to build to move the second piston and the blade engagement feature axially against the first plurality of blades; and a second section mill coupled to the stabilizer and having:

a second body with opposing first and second end portion, and a second axial bore in communication with the first axial bore and extending at least partially between the first and second end portions of the second body;

a second plurality of blades each having a first end portion and a second end portion, the first end portion of each of the second plurality of blades being movably coupled to the second body, and the second end portion of each of the second plurality of blades having a cutting surface thereon; and at least a third piston in the second axial bore and which is movable within the second axial bore in response to fluid pressure in the second axial bore to move the second plurality of blades from a second inactive position to a second active position; and actuating the second plurality of blades from the second inactive position to the second active position in response to an increase in fluid pressure in the second axial bore, the cutting surfaces of the second plurality of blades being radially outward from an outer surface of the second body in the second active position, wherein:

actuating the second plurality of blades includes increasing the fluid pressure above a shear value of one or more shear elements coupling the first piston to the body of the first section mill; and a bias element maintains the first piston at a first position when the first plurality of blades are in the inactive position.

15. The method of claim 14, further comprising:

rotating the downhole tool with the second plurality of blades in the second active position and thereby removing a first portion of casing and forming first and second segments of the casing having an axial gap therebetween; and actuating the second plurality of blades from the second active position to the second inactive position forming the axial gap.

16. The method of claim 15, further comprising moving the downhole tool axially within the wellbore while the first plurality of blades are in the first inactive position and aligning the first plurality of blades of the first section mill with the axial gap.

17. The method of claim 16, further comprising:

passing the impediment into the first axial bore of the first section mill, toward the seat, and forming a seal with the impediment against the seat;

actuating the first plurality of blades from the first inactive position to the first active position in response to an increase in pressure in the first axial bore; and rotating the downhole tool with the first blades in the first active position and thereby removing a second portion of the casing and increasing a length of the axial gap between the first and second segments of the casing.

18. The method of claim 17, further comprising:

stabilizing first and second section mills using a first stabilizer between the second end portion of the first body and the first end portion of the second body, and a second stabilizer below the second end portion of the second body and moving the downhole tool axially within the wellbore and aligning the second plurality of blades within the casing and above the gap while maintaining the second stabilizer within the casing and below the gap.

* * * * *